US008632213B2

(12) United States Patent
Patkus et al.

(10) Patent No.: US 8,632,213 B2
(45) Date of Patent: Jan. 21, 2014

(54) LIGHTING FIXTURE WITH FLOW-THROUGH COOLING

(75) Inventors: Steven Patkus, Sturtevant, WI (US); Bernd Sieberth, Salem, WI (US); Brian Kinnune, Racine, WI (US)

(73) Assignee: Cree, Inc., Durham, NC (US)

( * ) Notice: Subject to any disclaimer, the term of this patent is extended or adjusted under 35 U.S.C. 154(b) by 78 days.

(21) Appl. No.: 13/101,711

(22) Filed: May 5, 2011

(65) Prior Publication Data

US 2012/0281409 A1 Nov. 8, 2012

(51) Int. Cl.
*F21V 21/00* (2006.01)

(52) U.S. Cl.
USPC ..... 362/249.02; 313/46

(58) Field of Classification Search
USPC ..... 313/46; 362/249.02, 294, 373, 311.02, 362/311.14
See application file for complete search history.

(56) References Cited

U.S. PATENT DOCUMENTS

| | | | | |
|---|---|---|---|---|
| 6,529,375 | B2 | 3/2003 | Miyahara et al. | |
| 7,434,964 | B1 | 10/2008 | Zheng et al. | |
| 7,686,469 | B2 | 3/2010 | Ruud et al. | |
| 7,828,465 | B2 | 11/2010 | Roberge et al. | |
| 2009/0034261 | A1 | 2/2009 | Grove | |
| 2009/0251898 | A1 | 10/2009 | Kinnune et al. | |
| 2009/0296403 | A1 * | 12/2009 | Zhang et al. | 362/294 |
| 2010/0149809 | A1 | 6/2010 | Ruud et al. | |
| 2010/0314985 | A1 | 12/2010 | Premysler | |

OTHER PUBLICATIONS

Kramer Lighting, Sturtevant, WI. Excerpts from Kramer Lighting brochure. Quartz Cylinder Downlight specification. Copyright 2010.
Kramer Lighting, Sturtevant, WI. Excerpts from Kramer Lighting brochure. Metal Halide Cylinder Downlightt specification. Copyright 2010.
Affineon Lighting, Coral Springs, FL. Excerpts from Affineon Lighting. DL Downlight specification. Copyright 2009.
Affineon Lighting, Coral Springs, FL. Excerpts from Affineon Lighting. DLM Mini Downlight specification. Copyright 2008.

* cited by examiner

*Primary Examiner* — Anne Hines
(74) *Attorney, Agent, or Firm* — Jansson Munger McKinley & Shape Ltd.

(57) ABSTRACT

A lighting fixture including a housing having an inner surface and open first and second ends formed by closed-perimeter first and second edges, respectively, and defining an elongate top-to-bottom open space. The first end forms a light opening. A light-emitting arrangement is positioned in the open space. The arrangement includes (a) at least one light emitter positioned for directing light toward the light opening and (b) a heat sink connected to the light emitter(s). The heat sink preferably has a plurality of heat-dissipation surfaces extending away from the light opening. The heat sink is configured and positioned in the open space to facilitate fluid-flow therealong and through the open space.

25 Claims, 12 Drawing Sheets

LIGHTING FIXTURE WITH FLOW-THROUGH COOLING

FIELD OF THE INVENTION

This invention relates to lighting fixtures and, more particularly, to fixtures using LEDs.

BACKGROUND OF THE INVENTION

In recent years, the use of light-emitting diodes (LEDs) for various common lighting purposes has increased, and this trend has accelerated as advances have been made in LEDs and in LED-array bearing devices. Indeed, lighting applications which have been served by fixtures using high-intensity discharge (HID) lamps and other light sources are now increasingly beginning to be served by LEDs. Such lighting applications include many types of outdoor and indoor lighting, including roadway lighting, parking-lot lighting, factory lighting and recessed lighting. Creative work continues in the field of LED-lighting development, and also in the field of using LEDs for light fixtures in various applications, which increasingly extends to interior lighting, including high-ceiling surface lighting. It is the latter field to which this invention relates.

Lighting fixtures using LEDs as light source for various applications present particularly challenging problems in fixture development. Heat dissipation is one of the major problems that needs to be solved in LED light fixture.

Lighting-fixture adaptability is also an important goal for LED light that are often presented and mounted in different areas with broad spectrum of lighting requirements and with varying mounting ways.

In short, there is a significant need in the lighting industry for improved lighting fixtures using LEDs—fixtures that are adaptable for a wide variety of mountings and situations, and that satisfy the problems associated with heat dissipation.

OBJECTS OF THE INVENTION

It is an object of the invention to provide an improved lighting fixture that overcomes some of the problems and shortcomings of the prior art, including those referred to above.

Another object of the invention is to provide an improved lighting fixture that is readily adaptable for a variety of mounting positions and situations.

Another object of the invention is to provide an improved LED-lighting fixture an excellent heat dissipation.

Still another object of the invention is to provide a ceiling fixture mounting assembly configured for easy and convenient installation and performance of routine maintenance of the fixture.

How these and other objects are accomplished will become apparent from the following descriptions and the drawings.

SUMMARY OF THE INVENTION

The present invention is an improvement in LED lighting fixtures. The inventive lighting fixture includes a housing having an inner surface and open first and second ends formed by closed-perimeter first and second edges, respectively, and defining an elongate top-to-bottom open space. The first end forms a light opening. A light-emitting arrangement is positioned in the open space. The arrangement includes (a) at least one light emitter positioned for directing light toward the light opening and (b) a heat sink connected to the light emitter(s).

The heat sink preferably has a plurality of heat-dissipation surfaces extending away from the light opening. The heat sink is configured and positioned in the open space to facilitate fluid-flow therealong and through the open space.

It is highly preferred that the heat sink is so positined and arranged in the open space to permit constant air circulation through the heat sink. More specifically, cool air from outside the fixture enters the open space through the light opening. When the cool air is heated while flowing through the heat sink, it turns into hot air which raises up through the open top. The rising hot air removes heat from the heat sink and creates a vacuum which draws fresh cool air from outside the fixture into the light opening for flow through the heat sink. Such air circulation can occur indoor and outdoor.

The housing is configured to have substantially congruent cross-sections along substantially its entire length. In some embodiments, the housing is a cylindrical structure which, when hung vertically, has substantially vertical wall surrounding the open space. In some embodiments, the housing has a right cylindrical shape which has a surface generated by a straight line moving substantially parallel to the centerline along a full annular path, regardless of its shape. A preferred right cylindrical shape is generated by a substantially circular path of line movement, and most preferably is a surface which is coaxial with the centerline.

The open space has a centerline and the heat-dissipating surfaces are fins extending away from the centerline. The fins may extend radially away from the centerline. In some embodiments, the fins extend away from the centerline to terminate in distal edges spaced from the inner surface of the housing.

In some other embodiments, the fins extend away from the centerline to terminate in distal edges at the inner surface of the housing. In such embodiments, the light-emitting arrangement is substantially stabilized on the centerline. In some of such embodiments, there is only a set of fins of greater cross-dimension positioning their distal edges at the inner surface of the housing to hold the light-emitting assembly substantially on the centerline. Such set of fins with greater cross-dimension divide the open space into separate chimneys.

In some alternative embodiments, a centerer holds the light-emitting arrangement substantially on the centerline, thereby facilitating fluid-flow along the heat sink and through the open space. In such embodiments, the light-emitting arrangement is substantially free of contact with the inner surface of housing. The centerer is disposed between the light-emitting arrangement and the housing.

The centerer may include at least one bracket that is secured to the light-emitting arrangement. Such bracket preferably has a mounting portion secured to the light-emitting arrangement and at least one leg portion extending from the mounting portion to a free end at the inner surface of the housing. The centerer may further include a bumper secured to the free end of each leg portion. The bumper is preferably made of a polymeric or other suitable material reducing rattling sound in the fixture.

In preferred embodiments, the at least one light emitter includes an LED. The light emitter may be an LED-array module. The heat sink preferably includes a module-supporting portion with the LED-array module secured thereagainst and the heat-dissipation surface(s) extending from the module-supporting portion.

It is preferred that the LED-array module is recessed from the light opening. An inner wall preferably extends concentrically with the housing inner surface from the LED-array module to the light opening to form with the housing a venting gap permitting fluid-flow therethrough. The fixture preferably includes an end-portion secured to the inner wall interior and defining the light opening.

The LEDs are preferably mounted on a mounting board in a known manner. The mounting board preferably is a circuit board of a type known in the art, including those manufactured by Philips, Cree, Bridgelux, etc. The circuit board is preferably secured against the heat sink for dissipating heat produced by LEDs during operation. An LED emitter may be in a form of an "LED package,"—a term known in the industry, or any other form providing LED-emitted light. Some examples of LED packages have one or multiple number of light-emitting diodes on a base. Such multiple diodes may emit light with the same wave length which produce a common-color light. Alternatively, multiple diodes may emit light of different waive lengths thus different colors which may me blended to achieve a desired-color light. Persons skilled in the art would appreciate a broad variety of available LED emitters.

Term "centerline," as used with reference to the open space, means a line that indicates a center of at least one lateral dimension. For example, the fixture may have the open space and/or the light opening which are symmetrical along only one of its lateral dimension. In such example, the centerline will be along the axis of such symmetry. Alternatively, the housing may define an open space and/or a light opening having asymmetrical shape. In such case, the centerline will be situated along approximate center of such shape; and the emitter that is off-centerline is preferably in a farthest available position from such approximate center. The term "centerline" is in no way limiting the configuration of the housing or the light opening to any particular shape.

Each LED emitter defines an emitter axis. In preferred embodiments, the light-emitting arrangement includes a lens for each emitter at least one of which is off-centerline in a first lateral direction and has its associated lens configured for distribution of the emitter light in off-axial direction across the open space and passing through the opening at the end-portion that is off-centerline in the opposite lateral direction. Such off-axial light distribution widens the illumination angle from the fixture while having no more than minimal light directed onto the end-portion.

It is preferred that the mounting board is substantially planar. The mounting board preferably has a peripheral region surrounding a non-peripheral region. In such embodiments, the emitter(s) with the lens(es) configured for off-axial light distribution is/are on the peripheral region and at least one other emitter is on the non-peripheral region. The emitter on the non-peripheral region may have its associated lens configured for axial light distribution from the emitter with no more than minimal light directed onto the end-portion. The peripheral region preferably has a shape concentric with the opening.

It should also be understood that some embodiments of the present invention, which have fewer LEDs for a lower light output, may include only emitters with lenses configured for off-axial light distribution.

The off-axial light distribution, which allows a great widening of an angle at which LED-emitted light exits the fixture, is achieved with LED lenses specifically designed for directing mostly all of light from a selected emitter off-axially. In an example of such lens, the lens surfaces provides a total internal reflection (TIR) allowing a minimal loss of light. An example of the lenses that may be used to achieve such wide light distribution are described in U.S. patent application Ser. No. 12/173,721 filed on Jul. 15, 2008, the entire contents of which are incorporated herein by reference.

Preferred embodiments of the inventive lighting fixture include an enclosure forming a substantially closed chamber.

The enclosure may be positioned within the open space. It is highly preferred that such enclosure have a cross dimension which is smaller than the cross dimension of the open space therealong, thereby allowing fluid-flow within the open space and past the enclosure.

The enclosure within the open space may be positioned at the open second end of the housing. Such enclosure preferably has a cover which includes outwardly-extending mounting portions securing the enclosure to the housing while maintaining an open gap for fluid-flow thereabout to and from the open space. It is preferred that the light-emitting arrangement be secured with respect to the enclosure.

An LED driver is preferably within the chamber and electrically connected to the LED(s).

Depending on the fixture positioning and mounting configuration, the enclosure may be positioned substantially in the middle of the fixture. In such embodiments, two light-emitting arrangements may be positioned at both first and second open ends of the housing forming two respective light openings. Both light-emitting arrangements are preferably electrically connected to LED-driver(s) within the enclosure. Such fixture provides in two opposite directions such as light up and down.

The heat sink is preferably secured with respect to the enclosure. Such embodiments preferably include a connector securing the heat sink in spaced relation with respect to the enclosure.

For a given longitudinal housing dimension, the connector has a length chosen according to the longitudinal dimension of the heat sink that is required to accommodate necessary heat dissipation. This allows light-output adjustment of the lighting fixture without varying the longitudinal housing dimension.

For example, some fixture applications may have less-lighting requirement achievable with fewer LEDs. Low number of LEDs may produce a lower heat load such that a shorter heat sink may be sufficient and more economical. However, while only a few LEDs may be sufficient to satisfy lighting requirements, it may still be desirable to have the same overall look and dimensioning as those of fixtures with a greater number of LEDs and a longer heat sink.

It is preferred that the enclosure be preferably spaced away from the LED(s). The heat sink preferably forms a closed through channel providing a wire passage from the LED driver(s) to the LED(s). The heat sink may include a stem with the heat-dissipation surfaces extending therefrom. The heat-sink stem preferably includes the channel passing wires therethrough. The heat-sink stem preferably extends along the centerline. The heat-dissipation surfaces are preferably continuous-wall fins extending away from the stem.

The inventive light fixture may be adapted for several mounting ways. One such way is mounting to a vertical wall with a side arm or bracket. Another way is a pendant suspension from an overhead surface or structure utilizing a cable. Such pendant mounting allows for straight vertical suspension from inclined overhead surfaces or structures. And yet another mounting way is direct mounting of the fixture to an overhead structure or surface.

Another aspect of this invention is an assembly for mounting a fixture to an overhead surface. The inventive mounting arrangement significantly simplifies installation of the fixture in a suspended orientation with respect to a ceiling or other overhead structure. The inventive mounting arrangement permits such installation be performed by one person alone.

This is a great improvement to prior mounting arrangements which required at least two people for an installation of a single fixture. Such prior arrangements included several upwardly-positioned fasteners which needed to be tightened in a small space between a top of the fixture and the overhead surface. This required one person holding the fixture and at least one other person tightening the fasteners by using special tools which permit limited substantially-horizontal rotation for tightening vertically-oriented screws. Moreover, this very tedious and time-consuming operation has to be performed at great heights.

The inventive assembly includes a top member adapted for mounting with respect to the overhead surface. It is preferred that the top member include a substantially vertical wall defining a mounting way receiving a fastener therein.

The mounting way preferably has an open lower end an upward way-portion extending from the open lower end. A lateral way-portion extends laterally from the upward way-portion and terminates at a closed end.

The fastener includes a fastener head on a shaft extending substantially horizontally from the fixture. The substantially-horizontal orientation of the fastener facilitates its tightening in small spaces between the fixture top and the overhead surface. The fastener preferably has a tapered threaded shank and a slotted head having a cruciform into which a screwdriver with a cruciform point fits. Such fastener is known as Philips™ screw.

The fixture is mounted to the overhead surface or structure by mounting the top member with respect to the overhead structure. The fixture is positioned to align the fastener with the open end of the mounting way and then lifted to slide the fastener up the upward way-portion and continue sliding the fastener laterally along the lateral way-portion to the closed end thereof. Once the fastener is at the closed end, the fastener is tightened toward the fixture for firm and secure engagement therebetween.

The closed end of the mounting way is sized larger than a vertical cross-dimension of the lateral way-portion and smaller than the fastener head. When the fastener is tightened, the closed end receives the fastener head which is larger than the vertical cross-dimension of the lateral way-portion. The fastener head of the tightened fastener is, therefore, stopped from sliding back along the lateral way-portion, thereby holding the top member in fixed position against the fixture. To remove the fixture, the fastener just needs to be loosened enough to remove the fastener head from the closed end to slide the fastener shank back laterally through the mounting way and down and out the open end.

The fixture includes a substantially-horizontal top surface and a mounting wall extending upwardly from the top surface. The fastener extends substantially horizontally from the upwardly-extending mounting wall. The top-member vertical wall has a lower end which is positioned at the fixture top surface.

The inventive mounting assembly further includes a resilient member between the fixture top surface and the top-member lower end. The fastener and the lateral way-portion are each positioned at substantially equal distances from the fixture top surface and the top-member lower end, respectively. During installation, the resilient member is compressed to permit sliding of the fastener along the lateral way-portion. When released, the resilient member forces the fastener shaft against an upper edge of the lateral way-portion.

The top member includes a topwall configured for mounting to the overhead surface and a surrounding sidewall extending downwardly from the topwall. The surrounding sidewall includes an outward flange at the fixture to surface. The surrounding sidewall includes the vertical wall defining the mounting way.

The resilient member is preferably a gasket positioned between the top-member outward flange and the fixture top surface.

The mounting wall further preferably includes a securing slot extending between an open edge and a closed slot-end spaced laterally away from the fastener.

The top member includes a securing protrusion extending inwardly from the sidewall inner surface. The securing protrusion is positioned such that it is engaged by the securing slot of the mounting wall when the fastener is slid to the closed end of the mounting way.

In some preferred embodiments, the fixture includes at least a pair of spaced securing slots. And the top member includes a pair of spaced securing protrusions extending inwardly from the sidewall of the top member. Each securing protrusion is positioned to be engaged by the corresponding one of the securing slots.

The mounting wall preferably includes a foot portion affixed to the fixture top surface and an upright portion. The fastener extends from the upright portion. The fixture preferably includes a pair of free-standing spaced apart upward securing walls each spaced from the mounting wall. Each securing wall includes a foot portion affixed to the fixture top surface and an upright slotted portion which includes the securing slot.

Therefore, to mount the fixture to the overhead surface or structure, the fixture is positioned to align the fastener with the open end of the mounting way and then lifted to slide the fastener up the upward way-portion. The resilient member is compressed to permit sliding of the fastener along the lateral way-portion to the closed end thereof. While rotating the fixture to slide the fastener along the mounting way, simultaneously the securing slots rotate with the fixture and engage the securing protrusions of the top member. The mounting is completed by releasing the resilient member to force the fastener shaft against the edge of the closed end and tightening the fastener in the closed end such that the fastener head is recessed with respect to the lateral way-portion preventing any sliding back.

For most heat dissipation, it is preferred that substantially all parts of the fixture are made of aluminum. The top member bears the entire weight of the fixture and, therefore, is required to have greater strength. The top member is preferably made of steel that allows top-member wall be relatively thin while providing necessary strength.

DETAILED DESCRIPTION OF PREFERRED EMBODIMENTS

Figure 4:
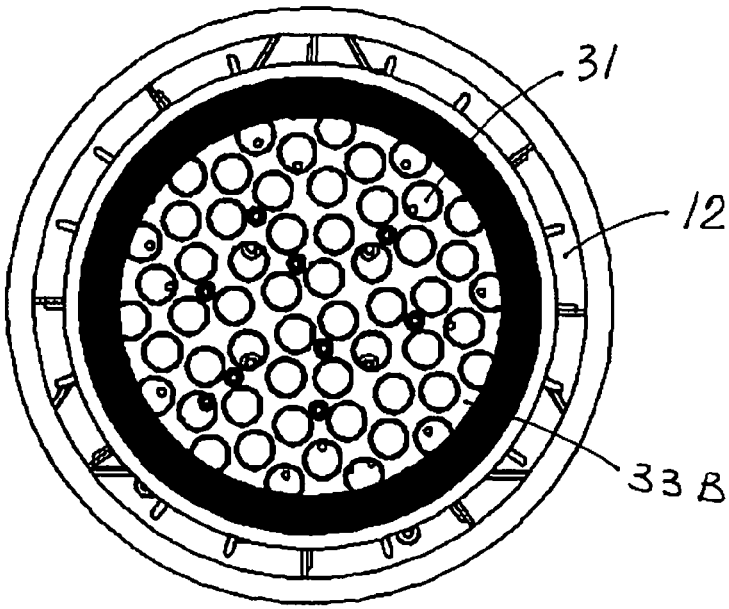
FIG. 4 is a bottom plan view of the inventive lighting fixture.
Figure 5:
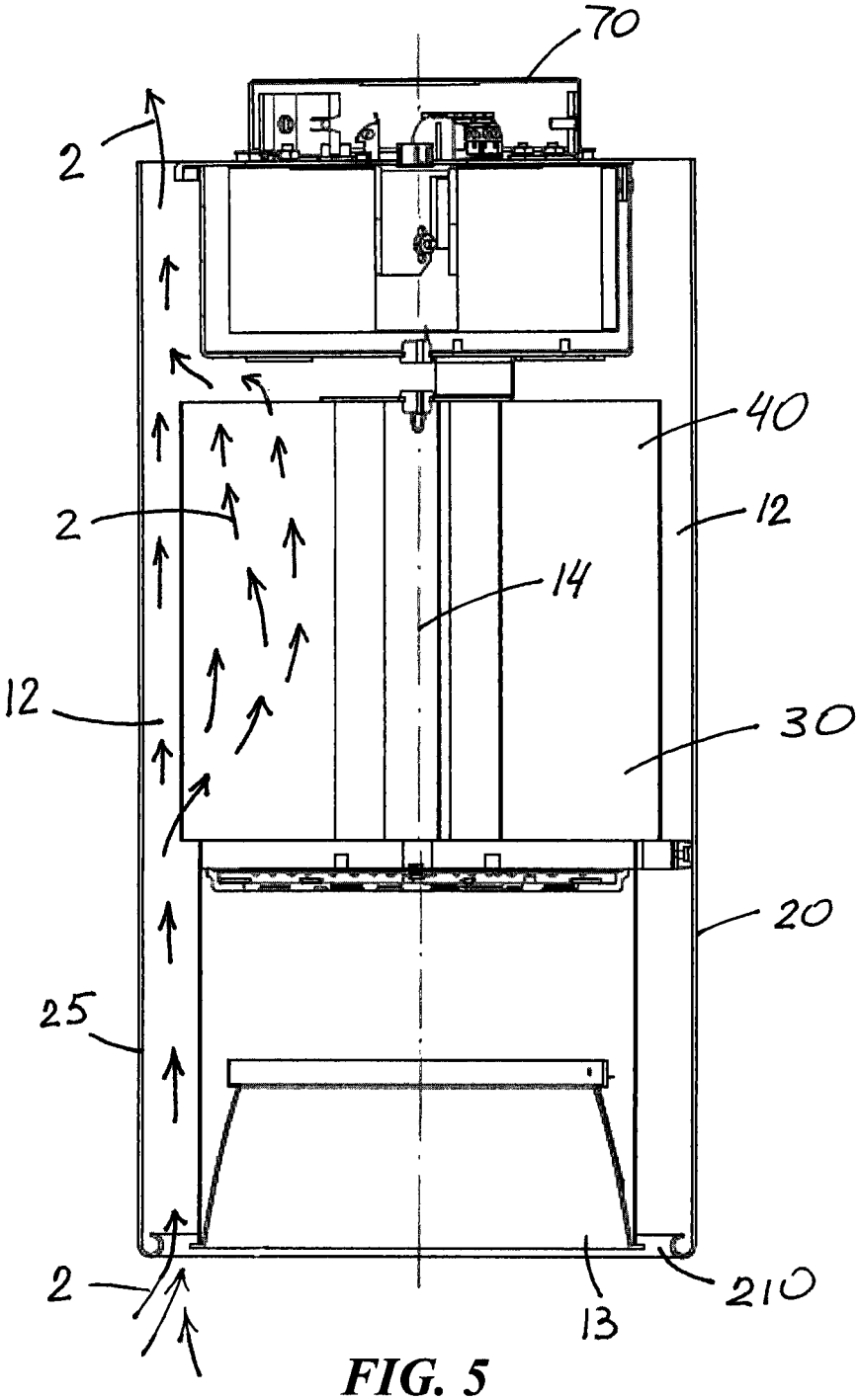
FIG. 5 is a cross-sectional view of the lighting fixture, as indicated in FIG. 3.
Figure 6:
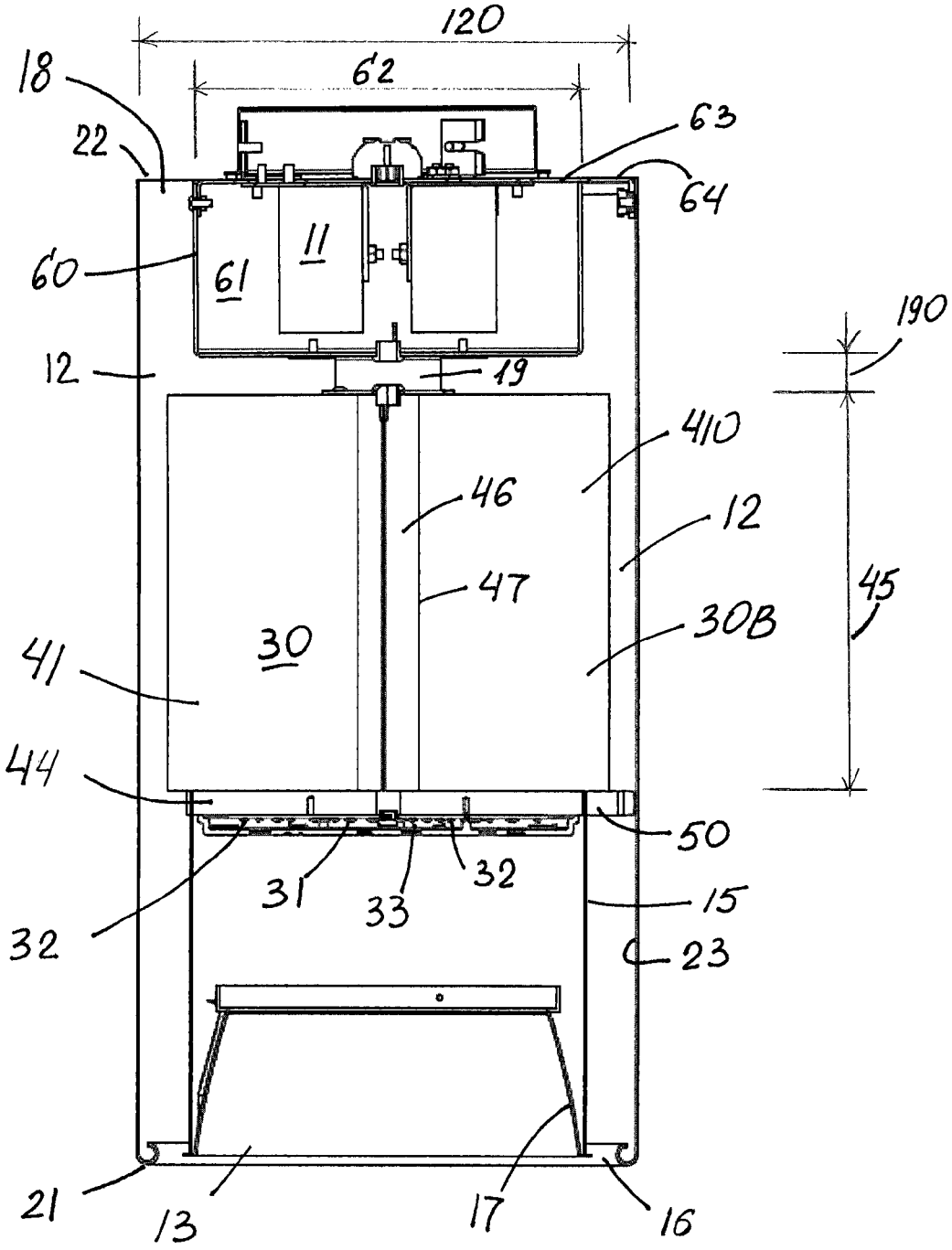
FIG. 6 is another cross-sectional view of the lighting fixture, as indicated in FIG. 3.
Figure 7:
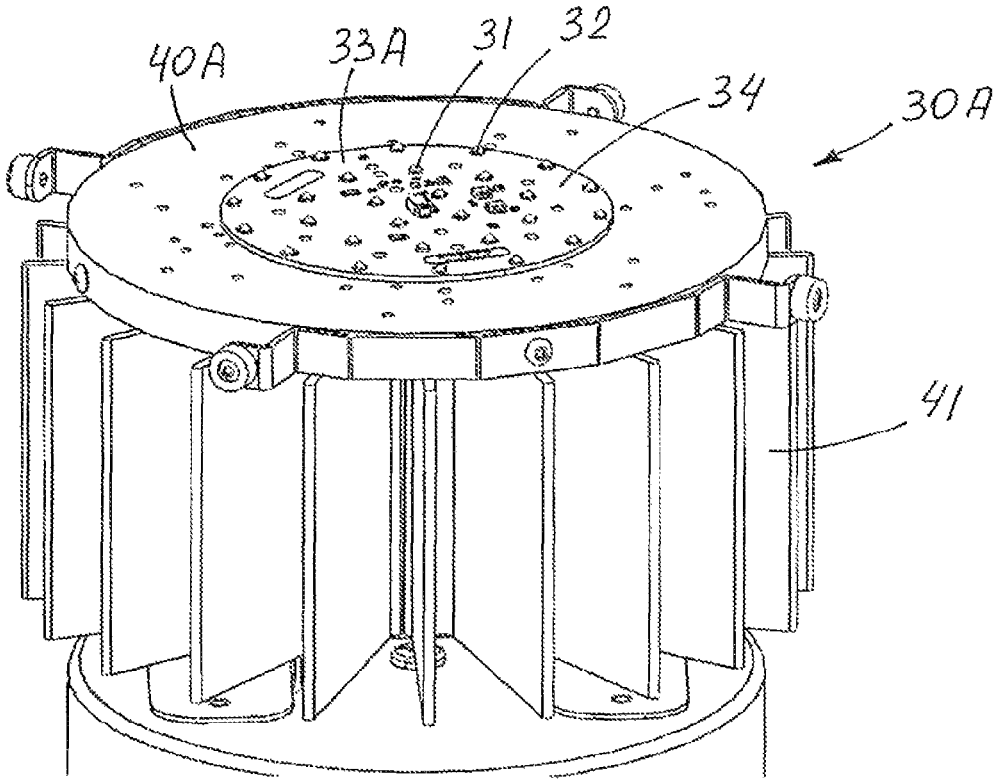
FIG. 7 is a perspective view of a light-emitting assembly.
Figure 8:
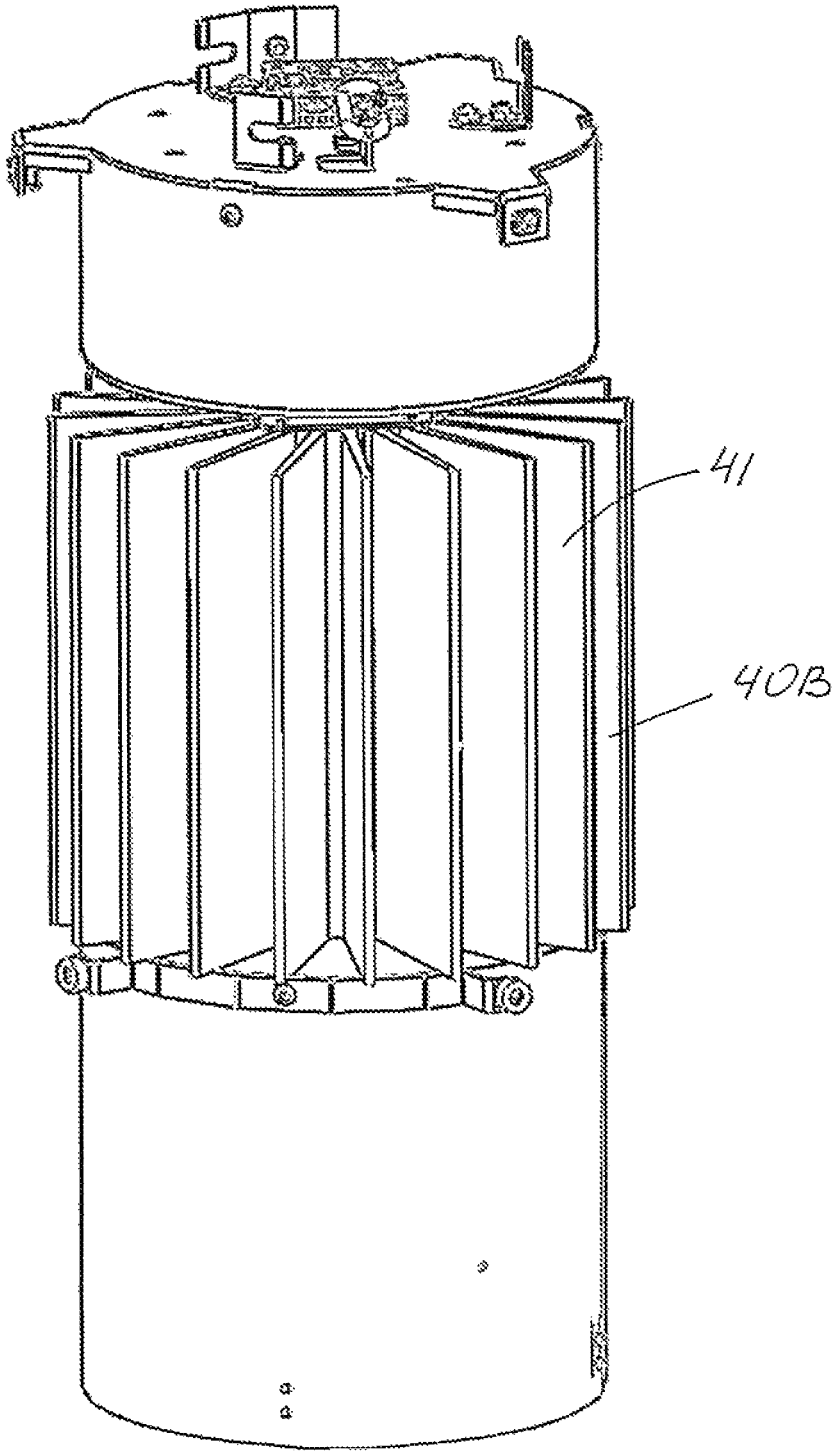
FIG. 8 is a perspective view of the light-emitting assembly secured with respect to a chamber enclosure and having an inner wall secured to the assembly.
Figure 10:
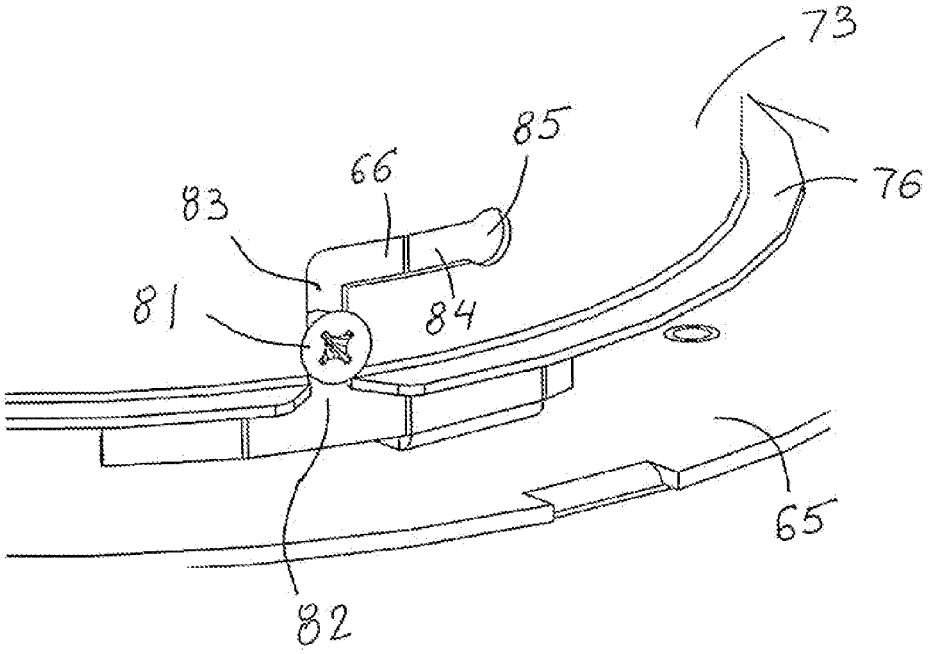
FIGS. 10 and 11 are fragmentary perspective views of the lighting fixture showing an inventive mounting arrangement with the fastener being sled along the mounting way.
Figure 11:
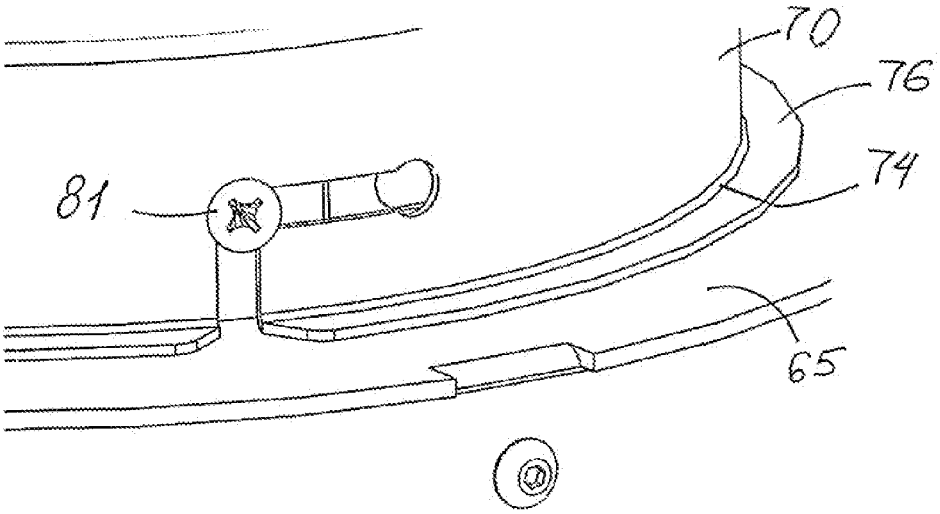

FIGS. 1-15 illustrate preferred embodiments of the inventive lighting fixture 10 which includes a housing 20 having an inner surface 23, an open first end 21 and an open second end 22 each formed by a closed-perimeter first and second edges 210 and 220, respectively. As best seen in FIGS. 4 and 6, housing 20 defines an end-to-end or top-to-bottom open space 12. The open space of the preferred embodiment shown in the figures has an elongate configuration. As seen in FIGS. 2 and 4-6, first end 21 forms a light opening 13. A light-emitting arrangement 30 is positioned within open space 12. Arrangement 30 includes (a) at least one light emitter 31 positioned for directing light toward light opening 13 and (b) a heat sink 40 connected to light emitters 31. FIGS. 7 and 8 best show heat sink 40 having a plurality of heat-dissipation surfaces 41 which extend away from light opening 13. As seen in FIGS. 3-6, heat sink 40 is configured and positioned in open space 12 to facilitate fluid-flow therealong and through open space 12. FIG. 5 illustrates circulation of air 2 through open space 12 and along heat sink 40.

Housing 20 illustrated in FIGS. 1-6 is a cylindrical structure which, when hung vertically, has substantially vertical wall 25 surrounding open space 12. Edge 21 is shown as having edge 210 curled inwardly for finished appearance.

Open space 12 has a centerline 14 (shown in FIG. 5) and heat-dissipating surfaces 41 are fins 410 extending away from centerline 14. FIGS. 3, 4, 7 and 8 show fins 410 extending radially away from centerline 14. In an embodiment illustrated in FIGS. 3-6, fins 410 extend away from centerline 14 to terminate in distal edges 43 spaced from inner surface 23 of housing 20.

Figure 17:
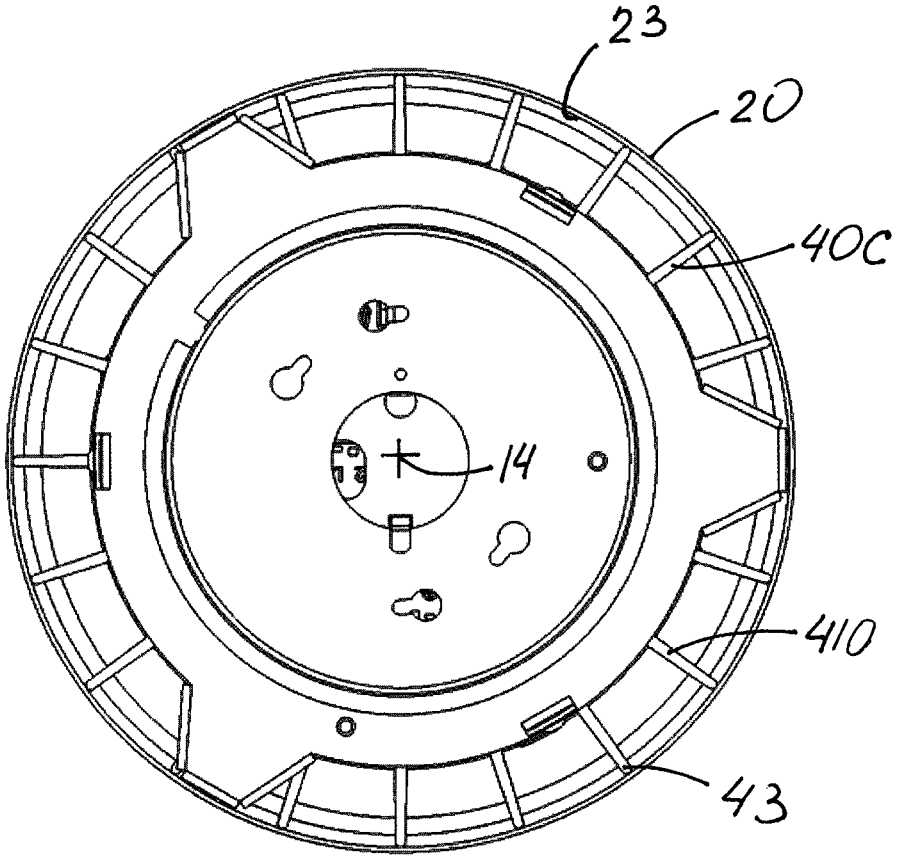
FIG. 17 is a top plan view of an embodiment with fin edges at the inner surface of the housing.

FIG. 17 shows an embodiment of lighting fixture 10 including heat sink 40C which has fins 410 extending away from centerline 14 to terminate in distal edges 43 at inner surface 23 of housing 20. It is seen in FIG. 17 that light-emitting arrangement 30 is substantially stabilized on centerline 14.

FIGS. 3, 5, 6 and 8 show a centerer 50 which holds light-emitting arrangement 30 substantially on centerline 14. Such centering of light-emitting arrangement 30 facilitates fluid-flow along heat sink 40 and through open space 12. FIGS. 5 and 6 show light-emitting arrangement 30 substantially free of contact with inner surface 23 of housing 20. It is further seen in FIGS. 3, 5 and 6 that centerer 50 is disposed between light-emitting arrangement 30 and housing 20.

Figure 1:
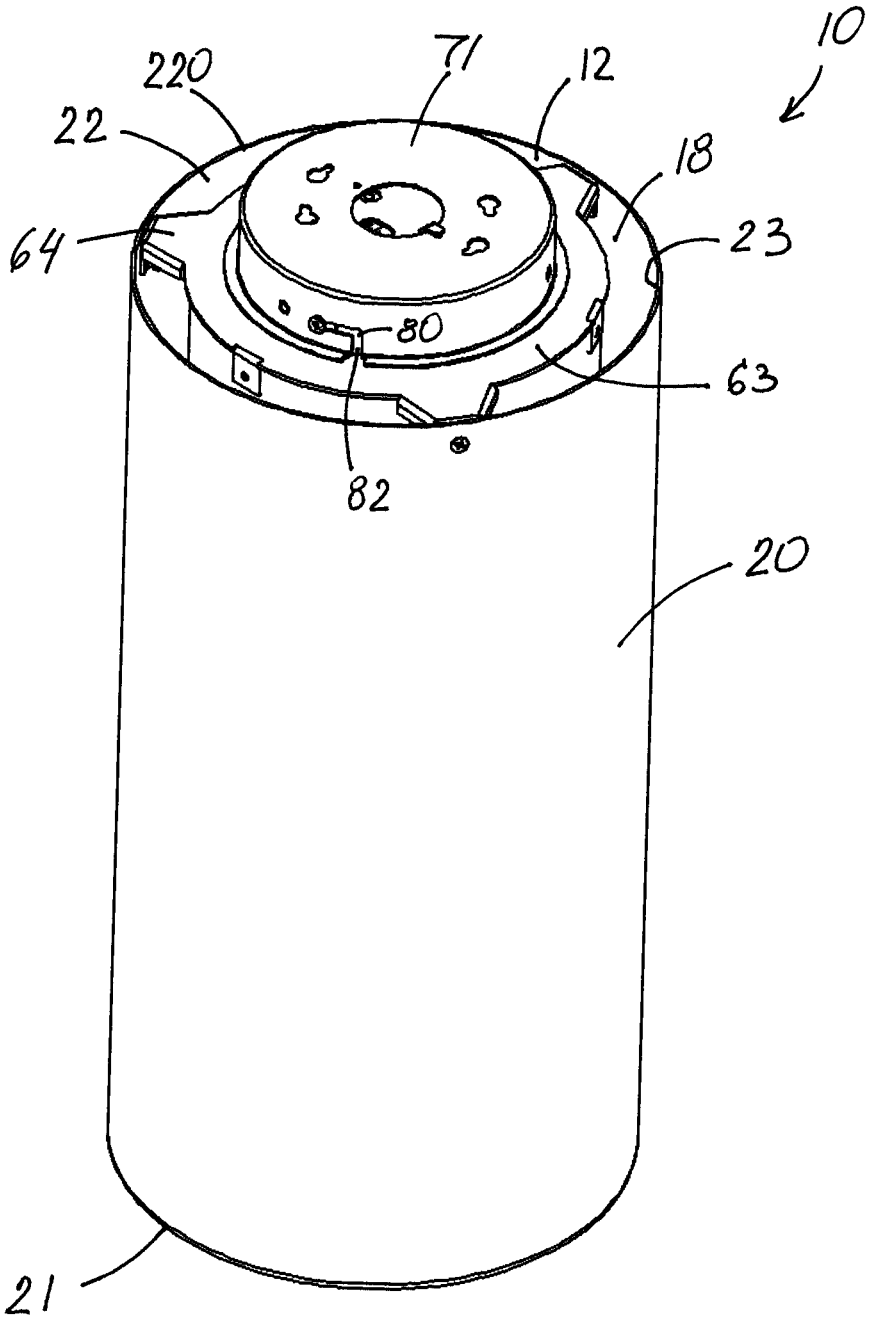
FIG. 1 is a top perspective view of a lighting fixture in accordance with this invention.
Figure 2:
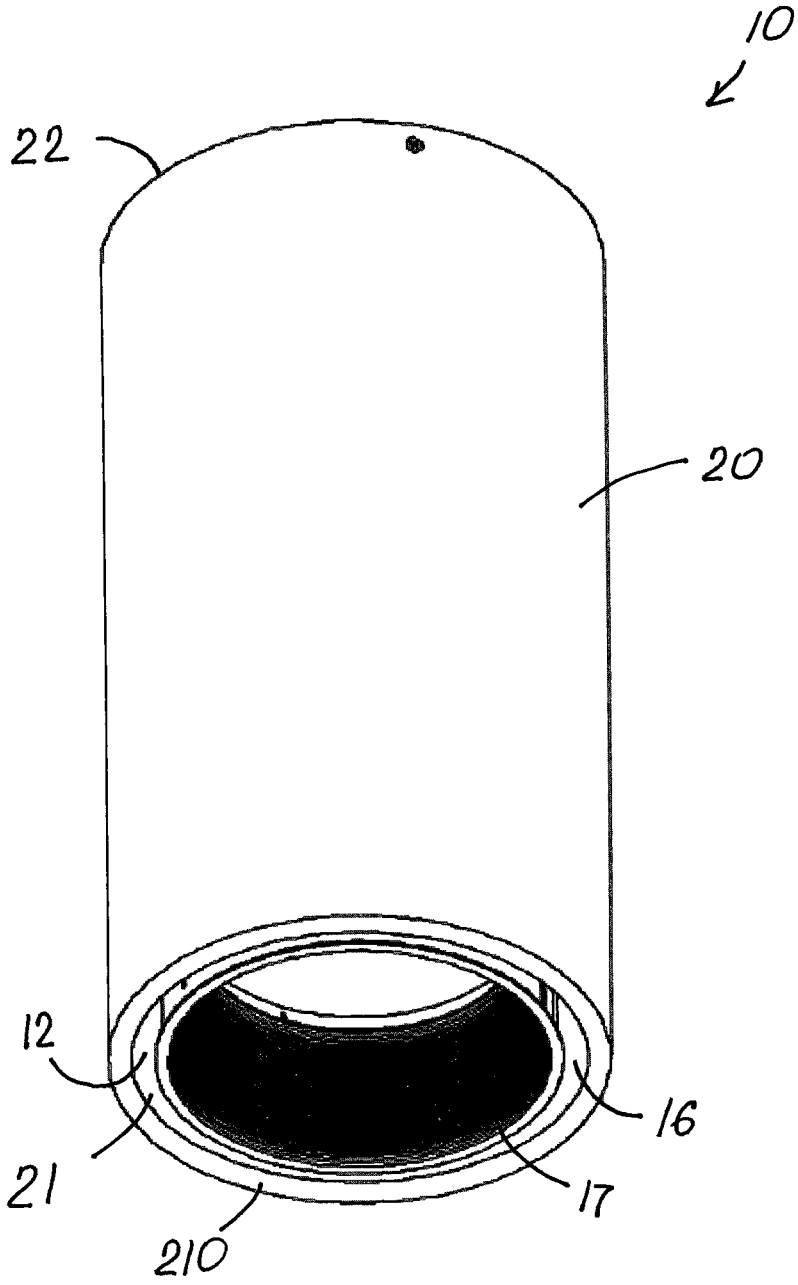
FIG. 2 is a bottom perspective view of the lighting fixture of FIG. 1.
Figure 3:
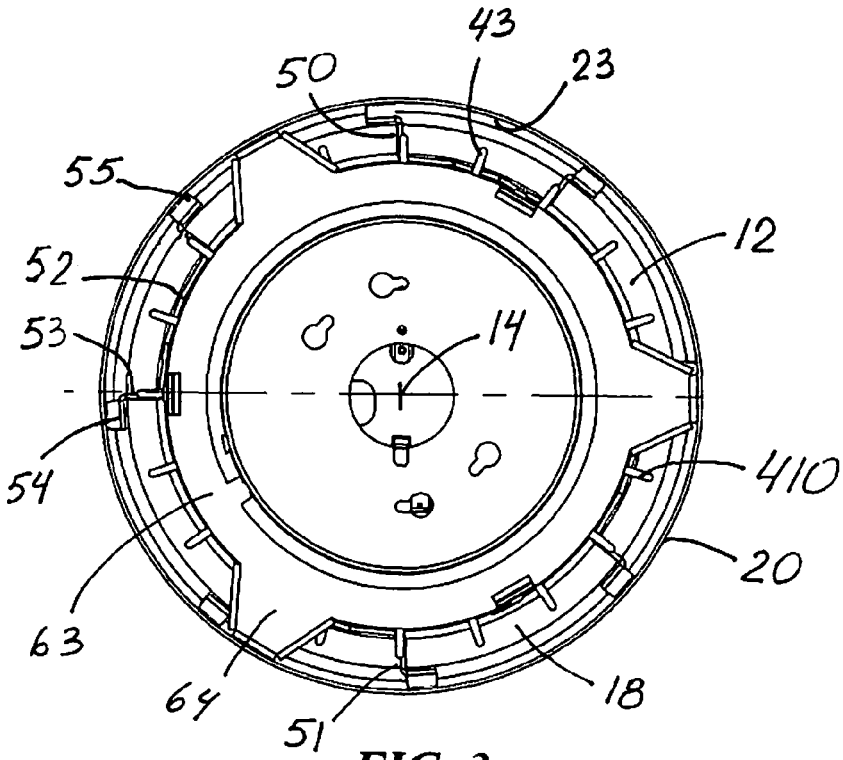
FIG. 3 is a top plan view of the inventive lighting fixture.

Centerer 50, as best seen in FIGS. 3 and 8, includes brackets 51 each secured with respect to light-emitting arrangement 30. Each bracket 51 has a mounting portion 52 secured at light-emitting arrangement 30 and at least one leg portion 53 extending from mounting portion 52 to a free end 54 at inner surface 23 of housing 20. It is further seen in FIGS. 3, 5, 6 and 8 that centerer 50 includes a bumper 55 secured to free end 54 of each leg portion 53.

FIG. 7 illustrates that light emitter 31 includes an LED 32. FIGS. 4 and 7 further show that light emitter 31 is an LED-array module 33. It is best seen in FIGS. 5-7 that heat sink 40 includes a module-supporting portion 44 with LED-array module 33 secured against such portion 44. Heat-dissipation surface(s) 41 extend from module-supporting portion 44.

In fixture 10, as illustrated in FIGS. 2, 5, 6, 8 and 15, LED-array module 33 is recessed from light opening 13. FIGS. 5 and 6 show an inner wall 15 extending concentrically with housing inner surface 23 from LED-array module 33 to light opening 13. FIGS. 5 and 6 further show that inner wall 15 forms with housing 20 a venting gap 16 permitting fluid-flow therethrough. As best seen in FIGS. 5 and 6, fixture 10 further includes an end-portion 17 secured within interior of inner wall 15 and surrounding light opening 13.

FIG. 7 illustrates that LEDs 32 are mounted on a mounting board 34 which is a circuit board of a type known in the art. Mounting board 34 is secured against heat sink 40 for dissipating heat produced by LEDs 32 during operation.

Figure 16:
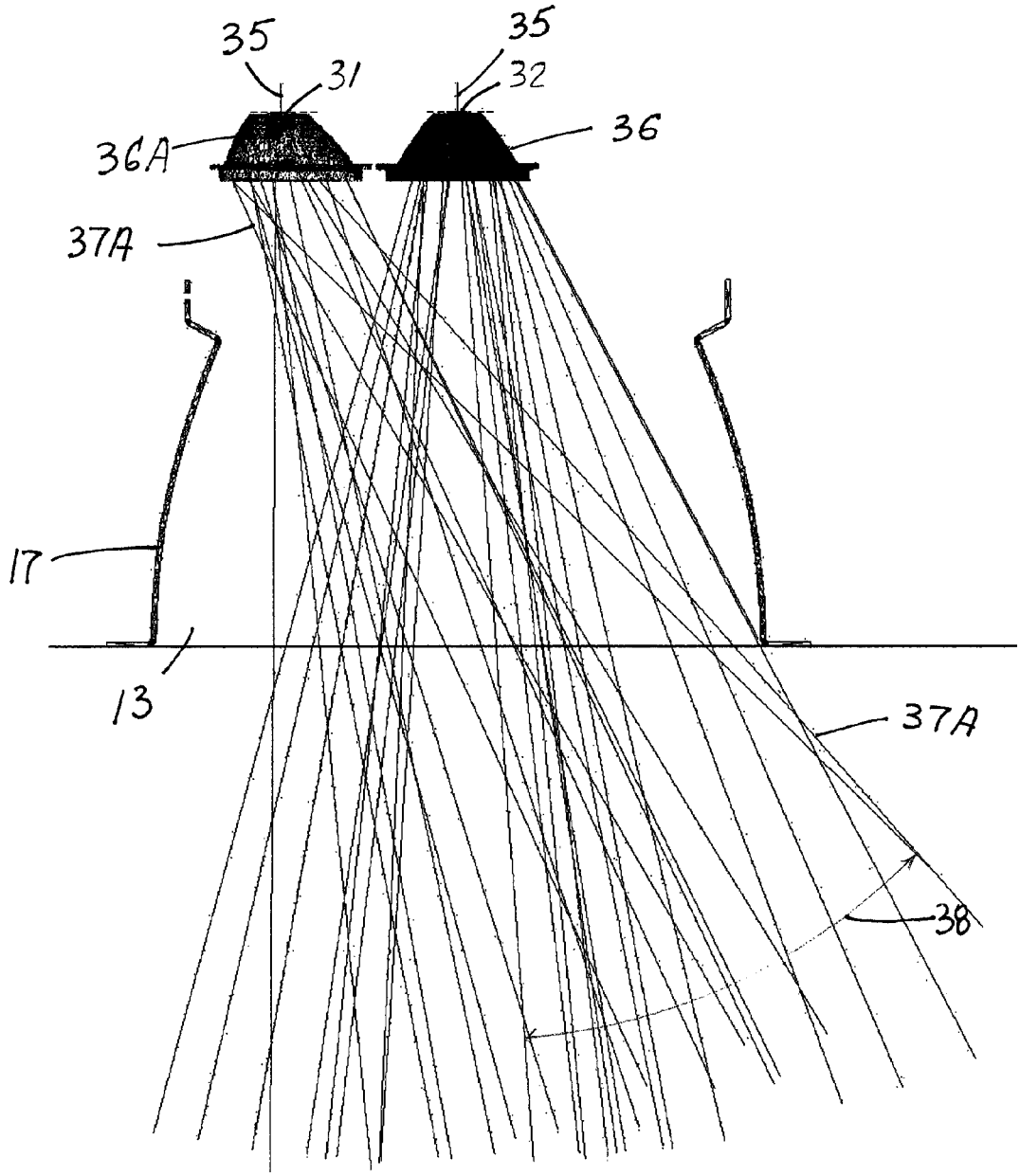
FIG. 16 is a schematic side view of an LED module having distribution of light in off-axial and axial direction with respect to each emitter axis by corresponding LED lenses.

FIG. 16 shows emitter axis 35 for each LED emitter 32. FIG. 16 further schematically illustrates light-emitting arrangement as including a lens 36 for each LED emitter 32. One emitter 31 is off-centerline in a first lateral direction and has its associated lens 36A configured for distribution of the emitter light 37A in off-axial direction across the lateral dimension of the space between LED emitter 32 and light opening 13 and passing through opening 13 at end-portion 17 that is off-centerline in the opposite lateral direction. Such off-axial light distribution widens the illumination angle 38 from fixture 10 while having no more than minimal light directed onto end-portion 17.

FIGS. 5, 6 and 8 show lighting fixture 10 including an enclosure 60 forming a substantially closed chamber 61. As best seen in FIGS. 5 and 6, enclosure 60 is positioned within open space 12 and has a cross dimension 62 which is smaller than corresponding cross dimension 120 of open space 12. Such dimensioning allows fluid-flow within open space 12 and past enclosure 60.

An LED driver 11 is preferably within chamber 61 and electrically connected to LEDs 32.

FIGS. 5 and 6 illustrate enclosure 60 at open second end 22 of housing 20. Enclosure 60 has a cover 63 (best seen in FIGS. 1, 3 and 6). Cover 63 includes outwardly-extending mounting portions 64 which secure enclosure 60 to housing 20 while maintaining an open gap 18 for fluid-flow about cover 63 to and from open space 12.

As seen in FIGS. 5, 6 and 8, light-emitting arrangement 30 is secured with respect to enclosure 60. FIGS. 5 and 6 best show that heat sink 40 is secured with respect to enclosure 60 and that a connector 19 secures heat sink 40 in spaced relation with respect to enclosure 60.

FIGS. 7 and 8 illustrate heat sink 40A and 40B having different longitudinal dimension 45 (shown in FIG. 6) that selected to accommodate necessary heat dissipation for a different number of LEDs. FIG. 7 shows light-emitting arrangement 30A which includes LED-array module 33A with fewer LEDs than LED-array module 33B shown in FIG. 4 and, therefore, heat sink 40A with longitudinal dimension 45 shorter than that of heat sink 40B shown in FIGS. 5, 6 and 8.

To accommodate a constant overall look and dimensioning of fixture 10 regardless of the number of LEDs and the dimensions of heat sink 40, connector 19 for light-emitting arrangement 30A has a length 190 chosen according to the longitudinal dimension 45 of heat sink 40A and which is longer than for connector 19 for light-emitting arrangement 30B with a greater number of LEDs 32 and longer heat sink 40B. This allows light-output adjustment of lighting fixture 10 without varying the longitudinal dimension of housing 20.

Figure 9:
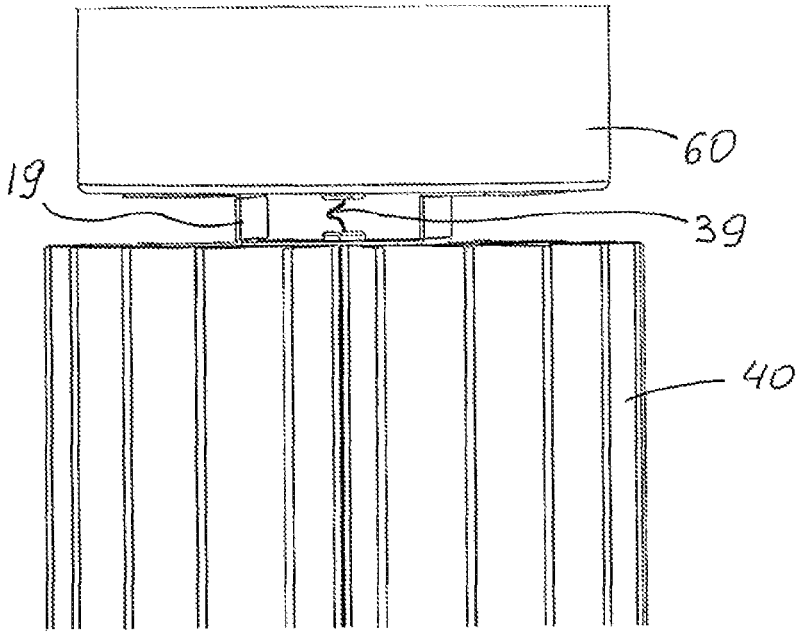
FIG. 9 is a fragmentary perspective view showing connection between the light-emitting arrangement and a chamber enclosure.

As seen in FIGS. 5, 6 and 9, enclosure 60 is spaced away from the LEDs 32. FIGS. 5 and 6 show heat sink 40 forming a closed through channel 46 providing a wire passage from LED drivers 11 to LEDs 32. Heat sink 40 includes a stem 47 with heat-dissipation surfaces 41 extending from stem 47. It is seen in FIGS. 5 and 6 that heat-sink stem 47 includes channel 46 passing wires 39 therethrough. As further seen in FIGS. 5 and 6, heat-sink stem 47 extends along centerline 14. Heat-dissipation surfaces 41 show in FIGS. 5-8 are continuous-wall fins 410 extending away from stem 47.

FIGS. 10-15 illustrate an assembly for mounting fixture 10 to an overhead surface 1. The assembly includes a top member 70 adapted for mounting with respect to overhead surface 1. As seen in FIGS. 1, 3, 5, 6, 14 and 17, the top member includes a topwall 71 and a surrounding substantially vertical sidewall 73 which extends downwardly from topwall 71 and defines a mounting way 80 receiving a fastener 81 therein.

Mounting way 80, which is best seen in FIGS. 1, 10, 11, 14 and 15, has an open lower end 82 and an upward way-portion 83 extending from open lower end 82. A lateral way-portion 84 extends laterally from upward way-portion 83 and terminates at a closed end 85.

Figure 12:
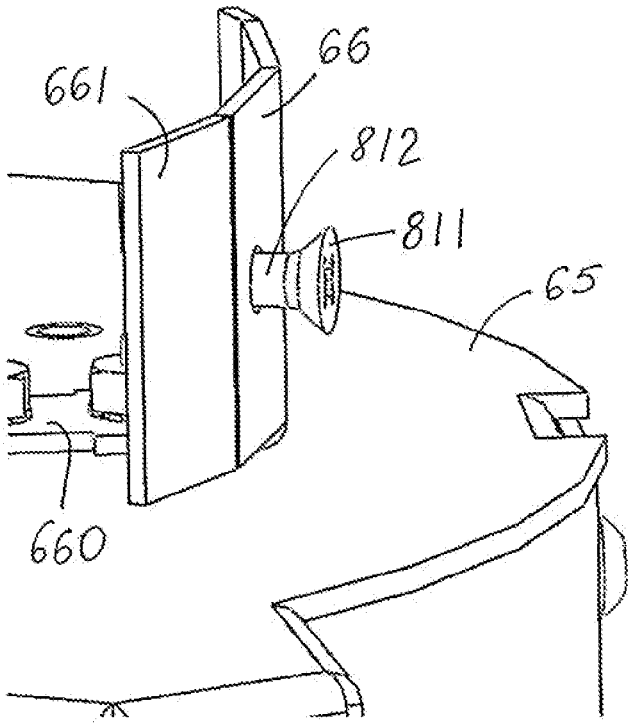
FIG. 12 is a fragmentary perspective view showing the fastener extending from a mounting wall on a top surface of the fixture.
Figure 13:
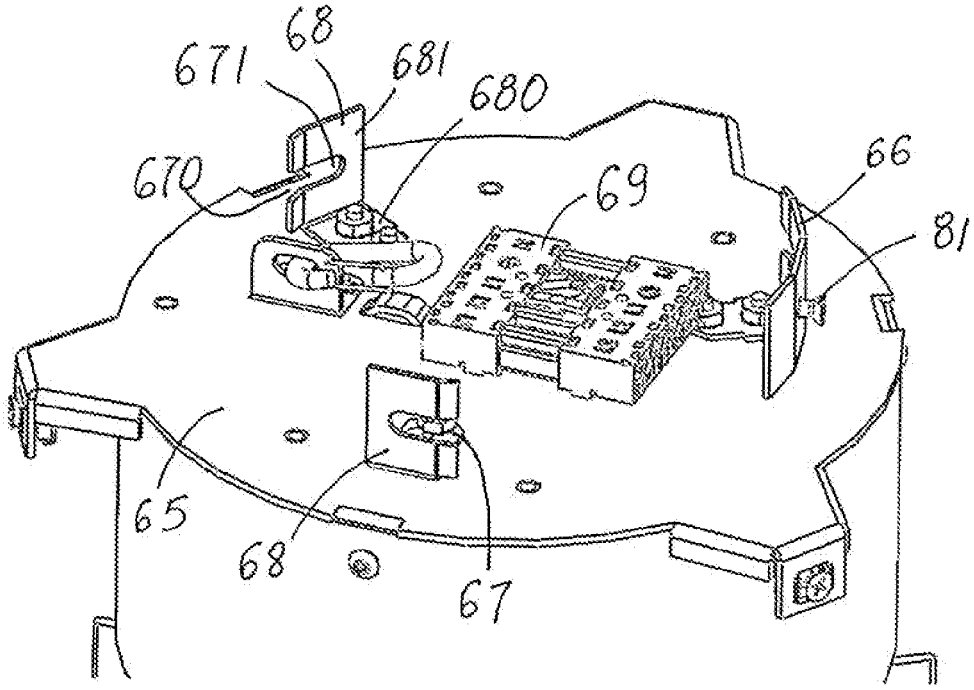
FIG. 13 is a fragmentary perspective view showing the top surface of the fixture with the mounting wall and a pair of securing walls extending therefrom.
Figure 15:
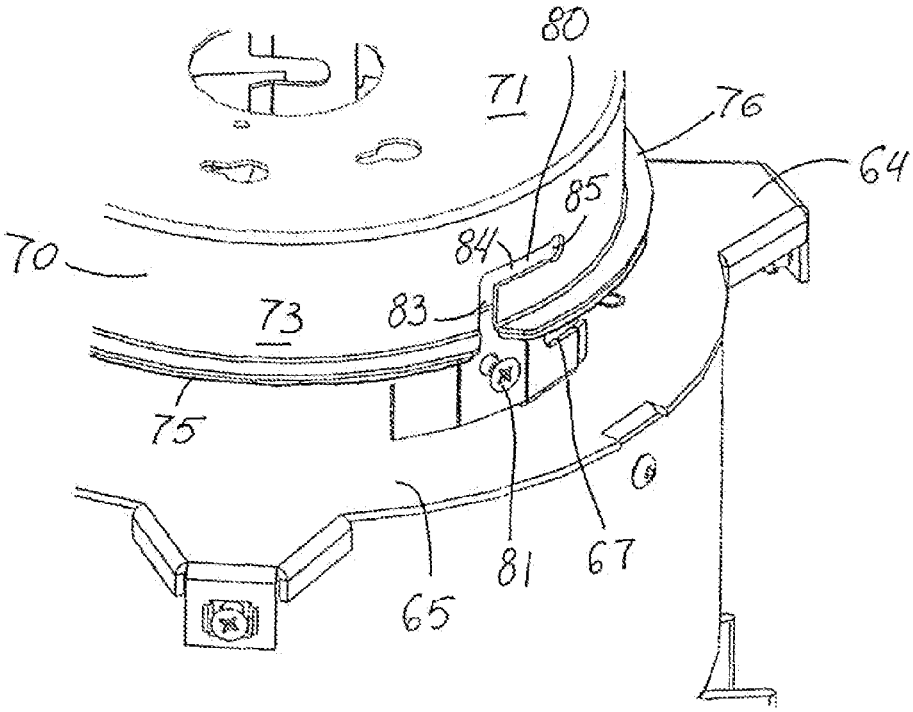
FIG. 15 is a fragmentary perspective view of the lighting fixture showing an inventive mounting arrangement prior to fastener entering a mounting way.

Fastener 81, which is best seen in FIGS. 12, 13 and 15, includes a fastener head 811 on a shaft 812 extending substantially horizontally from fixture 10. It is further seen in these FIGURES that fastener 81 has a tapered threaded shank FIGS. 10 and 11 further show that fastener head 811 is a slotted head having a cruciform into which a screwdriver with a cruciform point fits. Such fastener is known as Philips™ screw.

Fixture 10 is mounted to overhead surface 1 by mounting top member 70 with respect to overhead surface 1. Topwall 71 of top member 70 defines key-hole shaped apertures 72 dimensioned to accept screws secured to overhead surface 1. Therefore, top member 70 is mounted to overhead surface 1 with screws tightened through smaller part of key-hole apertures. Such mounting provides for easy removal of top member to overhead surface 1 by simply loosening the screws and twisting top member 70 to release the screws through the larger part of key-hole shaped apertures 72. Top member 70 can be easily re-attached to overhead surface 1 by lifting top member 70 to insert the screws into larger parts of each aperture 72, then twisting top member 70 to position each crew at the smaller end of each corresponding key-hole shaped aperture 72, thus have top member preliminary supported on screw heads, and securing top member 70 to overhead surface 1 by tightening the screws. Such operation can be clearly performed by one person alone which makes the fixture installation faster and less expensive.

Once top member 70 is secured to overhead surface 1, fixture 10 is positioned to align fastener 81 with open end 82 of mounting way 80. Fixture 10 is then lifted to slide fastener 81 up through upward way-portion 83 and continue laterally along lateral way-portion 84 to closed end 85. With fastener 81 at closed end 85, fastener 81 is tightened for firm and secure engagement between top member 70 and fixture 10.

As seen in FIGS. 10, 11, 14 and 15, closed end 85 of mounting way 80 is sized larger than a vertical cross-dimension of lateral way-portion 84 and smaller than fastener head 811. When fastener 81 is tightened, fastener head 811 is received in closed end 85 which is larger than the vertical cross-dimension of lateral way-portion 84. Fastener head 811 of tightened fastener 81 is, therefore, stopped from sliding back along lateral way-portion 84, thereby holding fixture 10 in fixed position against top member 70. To remove fixture 10, one person alone can loosen fastener 81 just enough to remove fastener head 81 from closed end 85 to slide fastener shaft 812 back laterally through mounting way 80 and down and out through open end 82.

FIGS. 12, 13 and 15 best illustrate that fixture 10 includes a substantially-horizontal top surface 65 and a mounting wall 66 extending upwardly from top surface 65. These FIGURES illustrate top surface 65 as an exterior surface of cover 63 of enclosure 60. Fastener 81 extends substantially horizontally from upwardly-extending mounting wall 66.

Vertical sidewall 73 of top member 70 has a lower end 74 which is positioned at top surface 65. Surrounding sidewall 73 further includes an outward flange 76 at top surface 65.

The mounting assembly further includes a gasket 75 between fixture top surface 65 and lower end 74. Gasket 75 is positioned between top-member outward flange 76 and top surface 65 of fixture 10.

Fastener 81 and lateral way-portion 84 are each positioned at substantially equal distances from top surface 65 and lower end 74, respectively. During installation, gasket 75 is compressed to permit sliding of fastener 81 along lateral way-portion 84. When released, gasket 75 forces fastener shaft 812 against an edge of lateral way-portion 84.

Mounting wall 66 further includes a securing slot 67 extending between an open edge 670 and a closed slot-end 671 spaced laterally away from fastener 81.

Figure 14:
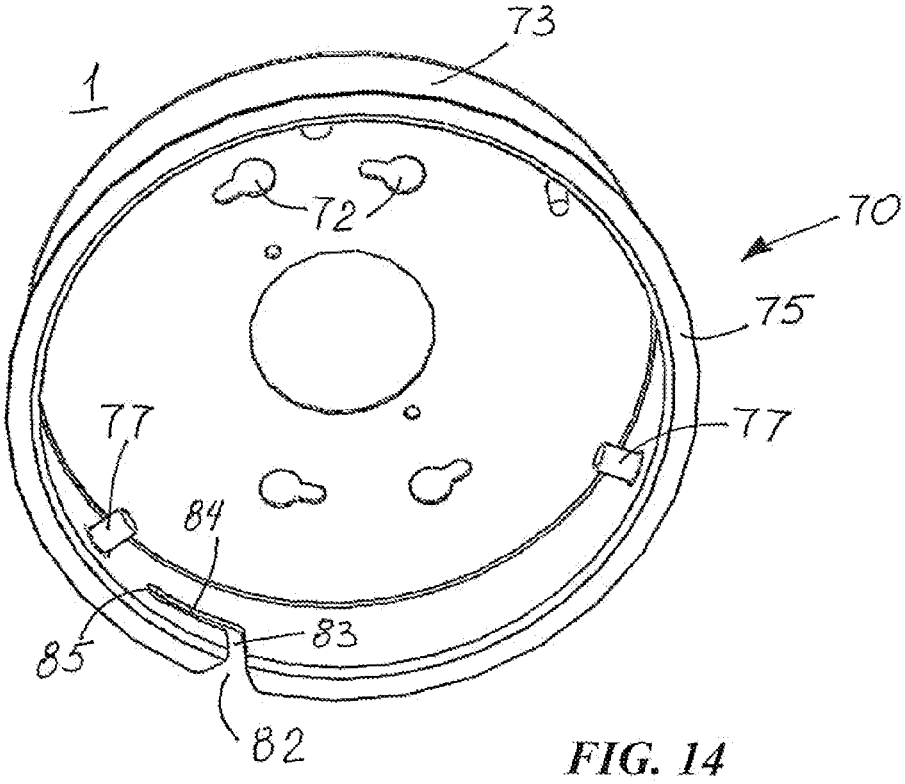
FIG. 14 is a perspective view of an interior of a top member with a resilient gasket secured thereto.

FIG. 14 shows that top member 70 includes a securing protrusion 77 extending inwardly from the inner surface of sidewall 73. Securing protrusion 77 is positioned to be engaged by securing slot 67 of mounting wall 66 when fastener 81 is slid to closed end 85 of mounting way 80.

FIGS. 13 and 14 show that fixture 10 includes three spaced securing slots 67. And, top member 70 includes three substantially-equally spaced protrusions 77 in the form of pins extending inwardly through sidewall 73. Each securing protrusion 77 is positioned to be engaged by corresponding one of securing slots 67.

As best seed in FIGS. 12 and 13, mounting wall 66 includes a foot portion 660 affixed to top surface 65 and an upright portion 661 extending from foot portion 660. Fastener 81 extends from upright portion 661. FIG. 13 illustrates that fixture 10 includes a pair of free-standing spaced-apart upward securing walls 68 each spaced from mounting wall 66. Each securing wall 68 includes a foot portion 680 affixed to top surface 65 and an upright slotted portion 681 which includes securing slot 67.

Therefore, to mount fixture 10 to overhead surface 1, fixture 10 is positioned at top member 70 secured to overhead surface 1. Fastener 81 is aligned with open end 82 of mounting way 80. Fixture 10 is then lifted to slide fastener 81 up along upward way-portion 83. Resilient gasket 75 is compressed to permit sliding of fastener 81 along lateral way-portion 84 to closed end 85 thereof. While rotating fixture 10 to slide fastener 81 along mounting way 80, securing slots 67 rotate with fixture 10 and engage securing protrusions 77 of top member 70. The mounting is completed by releasing resilient member 75 to force fastener shaft 812 against the edge of closed end 85 and tightening fastener 81 such that fastener head 811 is recessed with respect to lateral way-portion 84 preventing any sliding back.

A seen in FIGS. 1, 10, 11 and 15, top member 70 forms an enclosure for electrical leads 69 extending from chamber 61. Topwall 71 of top member 70 further defines an aperture 710 for passing a security cable therethrough.

While the principles of the invention have been shown and described in connection with specific embodiments, it is to be understood that such embodiments are by way of example and are not limiting.

The invention claimed is:

1. A lighting fixture comprising:

a housing having an inner surface and open first and second ends formed by closed-perimeter first and second edges, respectively, and defining an end-to-end open space, the first end forming a light opening;

a light-emitting arrangement in the open space, the arrangement including (a) at least one LED positioned for directing light toward the light opening and (b) a heat sink connected to the light emitter(s) and having a plurality of heat-dissipation surfaces extending away from the light opening, the heat sink configured and positioned in the open space to facilitate fluid-flow therealong and through the open space;

an LED driver spaced from the light-emitting arrangement; and a closed elongate channel formed through the heat sink of the light-emitting arrangement to provide a wire passage from the power-circuitry components to the LED(s).

2. The lighting fixture of claim 1 wherein the open space has a centerline and a centerer holds the light-emitting arrangement substantially on the centerline, thereby facilitating fluid-flow along the heat sink and through the open space.

3. The lighting fixture of claim 2 wherein:

the light-emitting arrangement is substantially free of contact with the inner surface of housing; and the centerer is disposed between the light-emitting arrangement and the housing.

4. The lighting fixture of claim 1 wherein the at least one light emitter includes an LED.

5. The lighting fixture of claim 4 wherein:

the light emitter is an LED-array module; and the heat sink includes a module-supporting portion with the LED-array module secured there against and the heat-dissipation surface(s) extending from the module-supporting portion.

6. The lighting fixture of claim 5 wherein:

the LED-array module is recessed from the light opening; and an inner wall extends concentric with the housing inner surface from the LED-array module to the light opening to form with the housing a venting gap permitting fluid-flow therethrough.

7. The lighting fixture of claim 4 further including an enclosure forming a substantially closed chamber having the LED driver positioned therein and electrically connected to the LED(s).

8. The lighting fixture of claim 7 wherein the enclosure is positioned within the open space, the enclosure having a cross dimension which is smaller than the cross dimension of the open space therealong, thereby allowing fluid-flow within the open space and past the enclosure.

9. The lighting fixture of claim 8 wherein:

the enclosure is positioned at the open second end of the housing; and the enclosure includes a cover which has outwardly-extending mounting portions securing the enclosure to the housing while maintaining the open gap for fluid-flow thereabout to and from the open space.

10. The lighting fixture of claim 1 wherein the heat sink includes a stem with the heat-dissipation surfaces extending therefrom, the heat-sink stem includes the channel passing wires therethrough.

11. The lighting fixture of claim 10 wherein the open space has a centerline and the heat-sink stem extends along the centerline, the heat-dissipation surfaces being continuous-wall fins extending away from the stem.

12. A lighting fixture comprising:

a housing having an inner surface and open first and second ends formed by closed-perimeter first and second edges, respectively, and defining an end-to-end open space, the first end forming a light opening; and a light-emitting arrangement in the open space, the arrangement including (a) at least one light emitter positioned for directing light toward the light opening and (b) a heat sink connected to the light emitter(s) and having a plurality of heat-dissipation surfaces extending away from the light opening, the heat sink configured and positioned in the open space to facilitate fluid-flow therealong and through the open space;

an enclosure forming a substantially closed chamber positioned within the open space at the open second end of the housing, the enclosure having a cover which has outwardly-extending mounting portions securing the enclosure to the housing while maintaining an open gap for fluid-flow thereabout to and from the open space, the light-emitting arrangement being secured with respect to the enclosure; and an LED driver within the chamber and electrically connected to the LED(s).

13. The lighting fixture of claim 12 wherein the housing is configured to have substantially congruent cross-sections along substantially its entire length.

14. The lighting fixture of claim 12 wherein:

the open space has a centerline;

the light-emitting arrangement is substantially free of contact with the housing; and a centerer holds the light-emitting arrangement and the inner wall along the centerline, thereby facilitating fluid-flow along the heat sink.

15. The lighting fixture of claim 12 wherein the heat sink is secured with respect to the enclosure.

16. The lighting fixture of claim 15 further including a connector securing the heat sink in spaced relation with respect to the enclosure.

17. The lighting fixture of claim 16 wherein, for a given longitudinal housing dimension, the connector has a length chosen according to the longitudinal dimension of the heat sink that is required to accommodate necessary heat dissipation, thereby allowing light-output adjustment of the lighting fixture without varying the longitudinal housing dimension.

18. The lighting fixture of claim 15 wherein:

the enclosure is spaced away from the LED(s); and the heat sink forms a closed through channel providing a wire passage from the LED driver(s) to the LED(s).

19. The lighting fixture of claim 18 wherein the heat sink includes a stem with the heat-dissipation surfaces extending therefrom, the heat-sink stem includes the channel passing wires therethrough.

20. A lighting fixture comprising:

a housing having an inner surface and open first and second ends formed by closed-perimeter first and second edges, respectively, and defining an end-to-end open space which has a centerline, the first end forming a light opening; and a light-emitting arrangement in the open space, the arrangement including (a) at least one light emitter positioned for directing light toward the light opening and (b) a heat sink connected to the light emitter(s) and having a plurality of heat-dissipation surfaces extending away from the light opening, the heat sink configured and positioned in the open space to facilitate fluid-flow therealong and through the open space; and a centerer holding the light-emitting arrangement substantially on the centerline, thereby facilitating fluid-flow along the heat sink and through the open space, the centerer comprising at least one bracket that is secured with respect to the light-emitting arrangement and has a mounting portion secured at the light-emitting arrangement and at least one leg portion extending from the mounting portion to a free end at the inner surface of the housing.

21. The lighting fixture of claim 20 wherein the heat-dissipating surfaces are fins extending away from the centerline.

22. The lighting fixture of claim 21 wherein the fins extend radially away from the centerline.

23. The lighting fixture of claim 21 wherein the fins extend away from the centerline to terminate in distal edges spaced from the inner surface of the housing.

24. The lighting fixture of claim 21 wherein the fins extend away from the centerline to terminate in distal edges at the inner surface of the housing.

25. The lighting fixture of claim 20 wherein the centerer further includes a bumper secured to the free end of each leg portion.

* * * * *